US005813520A

United States Patent [19]

Reier et al.

[11] Patent Number: 5,813,520

[45] Date of Patent: Sep. 29, 1998

[54] HOUSING AND ACTUATOR BUTTON ASSEMBLY

[75] Inventors: Bart Reier; Patrick Nixon, both of Raleigh; Robert Doran, Cary, all of N.C.

[73] Assignee: Ericsson, Inc., Research Triangle Park, N.C.

[21] Appl. No.: 895,970

[22] Filed: Jul. 17, 1997

[51] Int. Cl.[6] ..... H01H 13/70

[52] U.S. Cl. ..... 200/343; 200/330; 200/332

[58] Field of Search ..... 200/343, 329, 200/330, 332, 335, 341

[56] References Cited

U.S. PATENT DOCUMENTS 4,054,766 10/1977 Kramer ..... 200/343
4,394,555 7/1983 Long et al. ..... 200/343
4,613,853 9/1986 Hosogoe et al. ..... 200/343
4,877,925 10/1989 Kobyashi ..... 200/343
5,664,668 9/1997 Zainal et al. ..... 200/300

*Primary Examiner*—David J. Walczak
*Attorney, Agent, or Firm*—Jenkens & Gilchrist

[57] ABSTRACT

An actuator button is mounted in a housing by a cantilevered beam fixedly attached to the intermediate portion of a torsion beam. The ends of the torsion beam are nonrotatably fixed with respect to the housing. The actuator button is maintained at a normal, spaced-apart position with respect to a switch positioned within the housing. Movement of the actuator toward the switch induces bending stress in the cantilevered beam and torsional stress in torsion beam. The actuator button arrangement permits direct, vertical insertion of the actuator button into the housing, does not require any secondary assembly operations, and has a unitary construction.

17 Claims, 6 Drawing Sheets

HOUSING AND ACTUATOR BUTTON ASSEMBLY

TECHNICAL FIELD

This invention relates generally to a housing and an actuator button that extends through an opening in the housing, and more particularly to such a housing and actuator button assembly wherein the actuator button includes a torsion beam mounted to the housing.

BACKGROUND OF THE INVENTION

Actuator buttons, such as functional keys provided on cellular phones and similar telecommunication instruments, are well known and widely used devices to actuate an electrical switch positioned inside of the instrument enclosure. All such keys, or buttons, cooperate with an electrical switch to close a preselected circuit in the instrument. The electrical switches may have one of several different forms. For example, a discrete board-mount component or a snap dome covering a pattern on a printed circuit board.

Desirably, the actuator button provides a positive, well defined, trip or closure of the switch, returns to its original position after depression, and provides a tactile feedback to the operator. Many actuator button arrangements accomplish those objections through the use of a cantilever beam design, or with a molded rubber keypad. If the components are mounted in a sidewall of the housing, they generally require a secondary means, i.e., adhesive, ultrasonic welding, or additional pieces to require a secondary means, i.e., adhesive, ultrasonic welding, or additional pieces to hold them in place. Additionally, these methods generally require X and/or Y axis assembly, i.e., lateral translation with respect to a vertical Z axis. Neither the secondary means of attachment, nor the X and Y axis assembly, are readily adapted for assembly by automated tools.

Another arrangement for providing actuator buttons that are accessible from the exterior of an instrument uses a printed circuit board (PCB) with snap domes mounted directly on the board. The PCB is usually attached to a main board via a flexible cable. The snap dome is generally actuated by a rubber key. In the assembly of such an instrument, the rubber key must be inserted first, then the PCB mounted behind the rubber button. This typically requires either sliding the rubber button laterally into a compartment formed in the housing, or adhesively attaching the button to the inside of the housing or to the surface of printed circuit board.

It is therefore desirable to have an actuator button that is formed as a single member, and can be directly assembled with a housing by simple straight-line housing assembly that does not require secondary attachment means or processes, such as adhesive attachment or ultrasonic welding, to assembly the two components. Furthermore, it is desirable to have such an actuator button that is compact in size and requires minimum space usage inside the housing.

SUMMARY OF THE INVENTION

In one aspect of the present invention, a housing assembly comprises a housing having internal and external surfaces, an opening extending between the internal and external surfaces, and an actuator button having a first portion that extends through the opening in the housing when the actuator button is assembled with the housing. The first portion of the actuator button has a tactile surface that is disposed in substantially flush relationship with an external surface of the housing. A second portion of the actuator button includes a base, from which the first portion of the actuator button extends, and an elongated torsion beam spaced from the base. The elongated torsion beam has a pair of spaced-apart end portions each adapted to be mounted in a means, disposed on an internal surface of the housing, for nonrotatably retaining the spaced-apart ends of the torsion beam in fixed relationship with the housing. The elongated torsion beam also has an intermediate portion disposed between the spaced-apart end portions of the beam. The actuator button further includes a cantilevered beam that extends between the intermediate portion of the torsion beam and the base of the actuator button and is attached in respective fixed relationship to both the intermediate portion of the torsion beam and to the base.

Other features of the housing assembly embodying the present invention include the first and second portion of the actuator button being integrally formed as a single, one-piece member. Additionally, the spaced-apart end portions of the torsion beam may have a cross-sectional shape at least partially defined by a plurality of generally orthogonally disposed flat surfaces, and the means for retaining the end portions of the torsion beam in nonrotatable relationship with respect to the housing includes a pair of notches, each of which has a plurality of flat surfaces arranged to mate the flat surfaces defined on a respective end of the torsion beam.

Still other features of the housing assembly embodying the present invention include the housing having a pair of anti-rotation platforms disposed on the internal surface of the housing, in spaced-apart relationship to each other, at a distance substantially equal to the spaced-apart distance of the end portions of the torsion beam. The torsion beam may also include an arm extending radially outwardly from each of the spaced-apart end portions, and are radially positioned at an angle whereby depression of the tactile surface of the actuator button urges the arms of the torsion beams into biased abutment with respective ones of the anti-rotation platforms of the housing, and prevents rotation of the end portion of the torsion beam in a direction towards the anti-rotation platforms. The housing and actuator button assembly is particularly adapted to operatively actuate at least one push-button or microswitch of a telecommunication instrument in response to manually depressing the actuator button.

In another aspect of the present invention, an actuator button comprises first and second portions. The first portion is adapted to extend through an opening in a housing and has a tactile outer surface. The second portion of the actuator button has a base from which the first portion of the button extends and an elongated torsion beam spaced from the base. The elongated beam has a pair of spaced-apart ends, each adapted for mounting in fixed relationship with the housing. The elongated torsion beam further has an intermediate portion disposed between the spaced-apart end portions. The second portion of the actuator button also has a cantilevered beam extending between the intermediate portion of the elongated torsion beam and the base of the second portion of the actuator button. The cantilevered beam is attached in respective fixed relationship to the intermediate portion of the torsion beam and to the base of the actuator button.

Other features of the actuator button embodying the present invention include the first and second portions of the actuator button being integrally formed as a single, one-piece member, and each of the spaced-apart ends of the torsion beam having a cross-sectional shape at least partially defined by a plurality of generally orthogonal flat surfaces. Additional features include the torsion beam having an arm extending outwardly from each of the spaced-apart end portions at a radial angle whereby depression of the tactile surface of the actuator button urges the arms of the torsion beam into biased abutment against an internally disposed surface of the housing. Additional features further include the base of the second portion of the actuator button having a first surface from which the first portion of the actuator button extends. The actuator button embodying the present invention is particularly useful in operatively controlling at least one electric circuit of a telecommunication instrument in response to manually depressing the tactile surface of the button.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION

Figure 1:
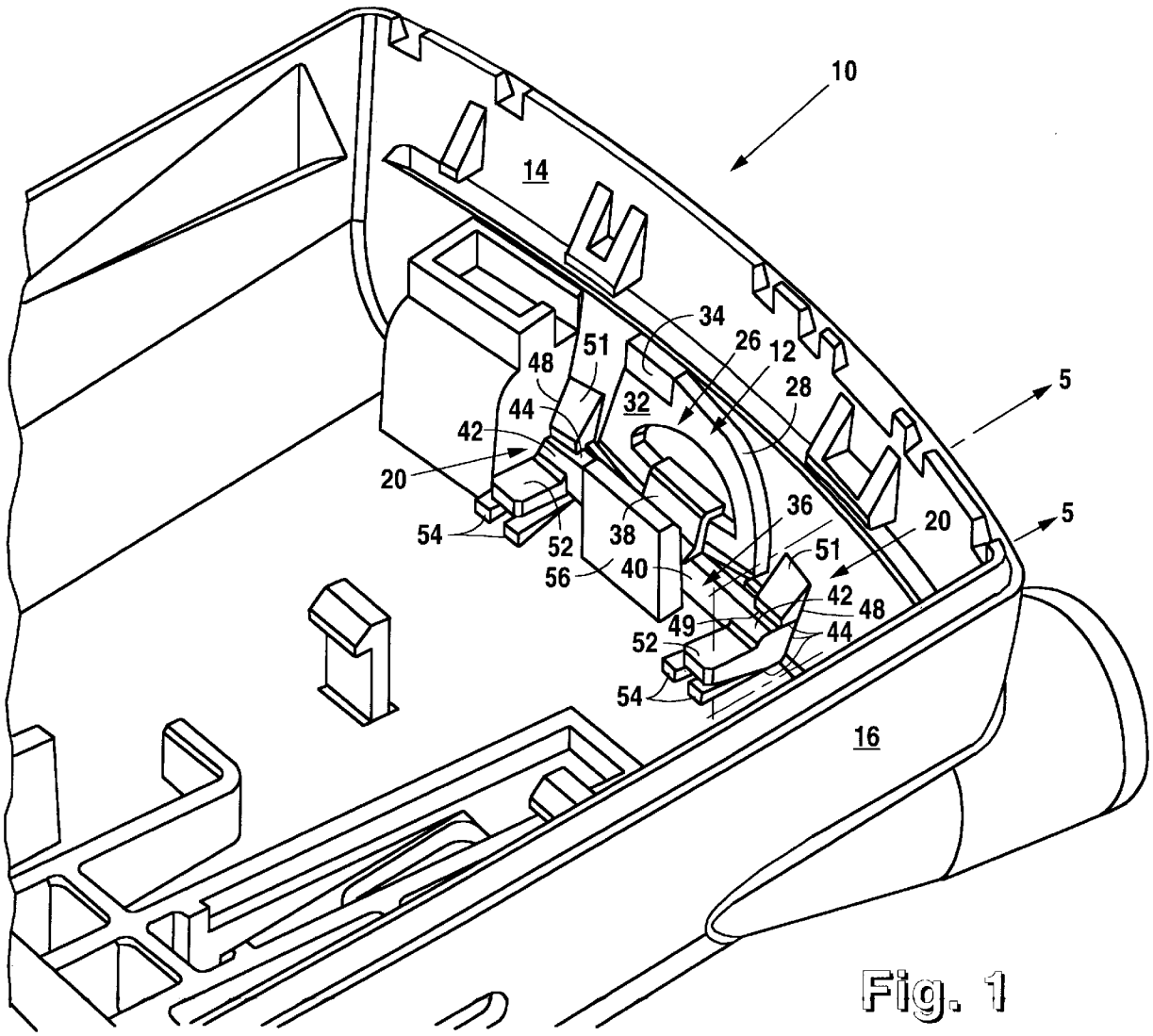
FIG. 1 is a perspective view of a housing and actuator button assembly embodying the present invention, showing the portion of the housing in which the actuator button is mounted.
Figure 2:
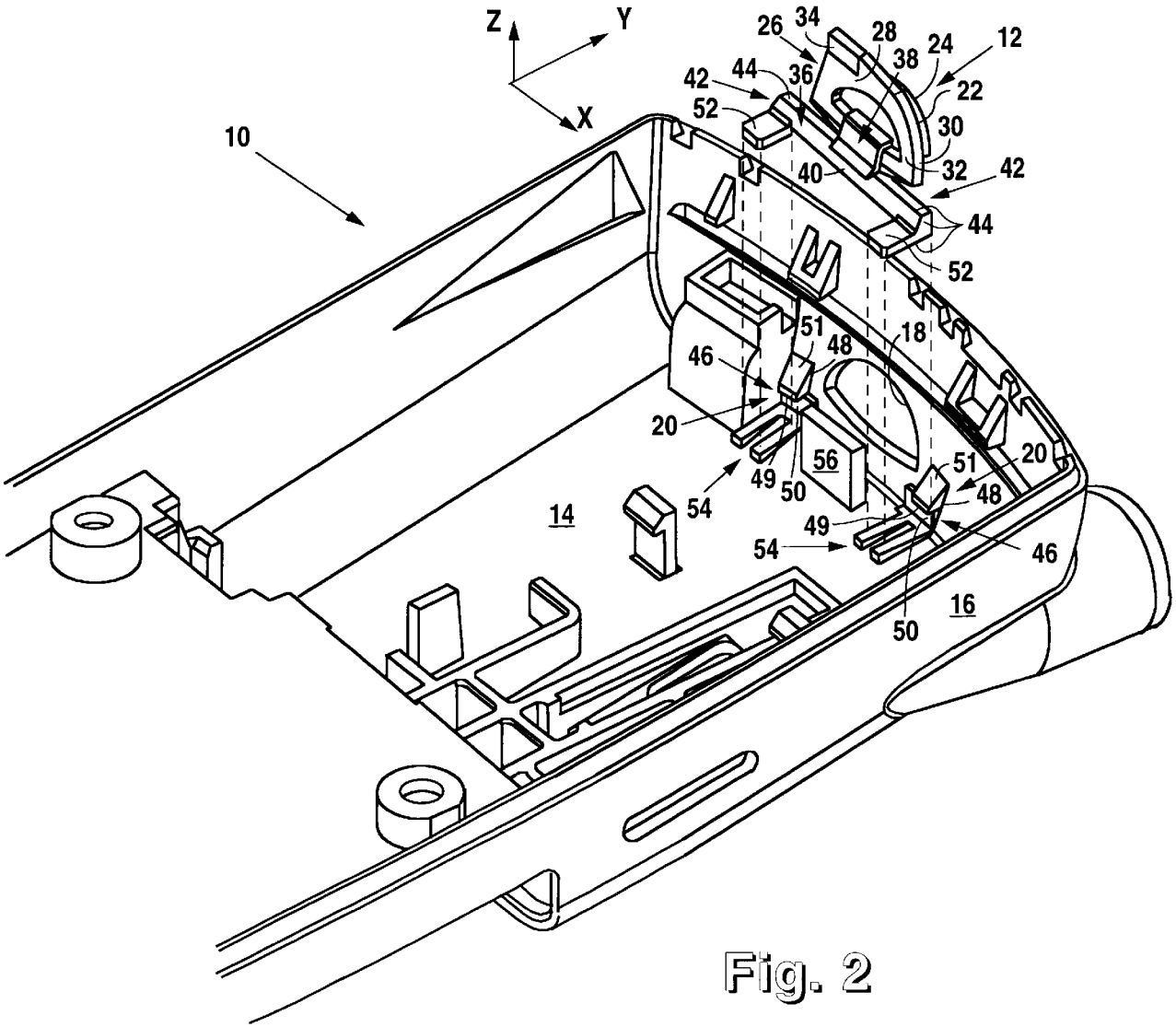
FIG. 2 is a perspective view of a housing and actuator button assembly embodying the present invention, showing the actuator button spaced from the housing prior to assembly.

In the preferred embodiment of the present invention, a housing and actuator button assembly comprises a housing 10, a portion of which is shown in perspective in FIGS. 1 and 2, and an actuator button 12. In the preferred illustrative embodiment, the housing 10 is a portion of the case of a cellular telephone, and has an internal surface 14 that partially defines a cellular phone enclosure. The housing 10 also has an external surface 16 that typically provides access to a plurality of keys, a liquid crystal display panel, and/or other information-transmitting or function-controlling keys or buttons. The housing 10 has at least one opening 18, formed at one side or end of the housing 10, that extends between the internal surface 14 and the external surface 16 of the housing 10. The housing 10 also includes a means 20 for retaining two end portions of a torsion beam in a nonrotatable relationship with respect to the housing 10, as described below in greater detail.

The actuator button 12 has a first portion 22, as shown in FIGS. 2–4 and 6, that extends through the opening 18 in the housing 10. The first portion 22 of the actuator button 12 has a tactile surface 24 that, when the actuator button 12 is assembled in the housing 10, is adjacent to, or slightly raised from, the external surface 16 of the housing 10. The tactile surface 24 typically has the function symbol or other cosmetic decoration which provides visual identification of the function of the button 12. If desired, the tactile surface 24 may be formed of a resilient material such as silicon rubber, either as an insert joined to the button 12 before assembly with the housing 10, or as an insert molded with the actuator button 12.

Figure 6:
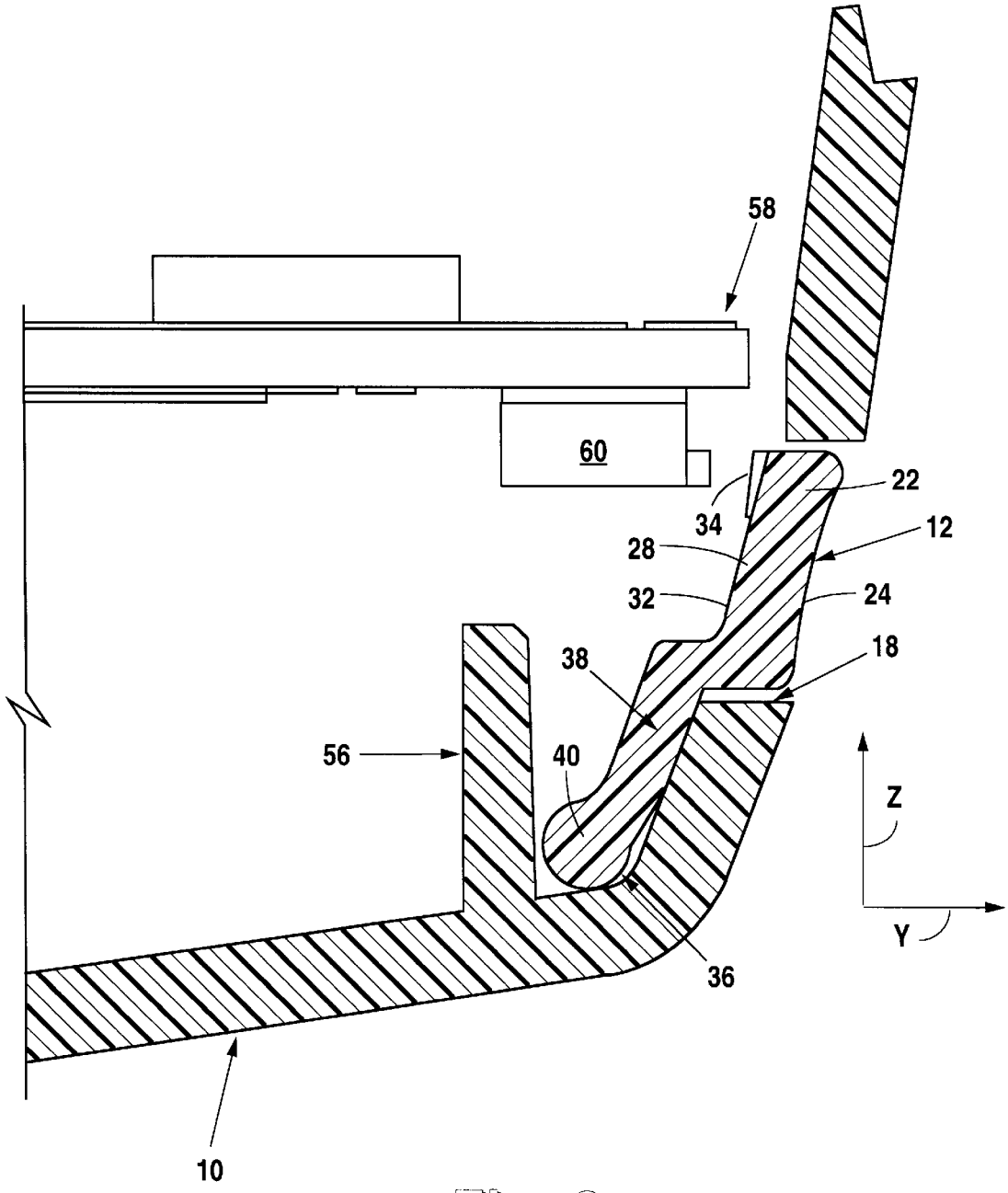
FIG. 6 is a cross-sectional view of the housing and actuator button assembly embodying the present invention, showing, in plan view, a printed circuit board mounted in the housing and which has a pressure-actuated switch mounted thereon and positioned such that its operation is controlled by the actuator button.

The actuator button 12 further has a second portion 26 that, as best shown in FIG. 1, is wholly disposed within the housing 10. The second portion 26 includes a base 28 from which the first portion 22 of the actuator button 12 is supported. The base 28 has a first surface 30 and a second surface 32, respectively, disposed on opposed sides of the base 28. The first portion 22 of the actuator button 12 extends from the first surface 30, and a pad 34 is disposed on the second surface 32 of the base 28. When the button 12 is depressed, the pad 34 contacts at least one pressure-actuated switch 60, e.g., a push-button switch, disposed within the housing, as shown in FIG. 6.

Importantly, the actuator button 12 embodying the present invention has an elongated torsion beam 36 that is spaced from the base 28 and is interconnected to the base 28 by a cantilevered beam 38 that is attached at one end to an intermediate portion 40 of the torsion beam 36 and at the opposite end to the movable base 28 of the actuator button 12. The elongated torsion beam 36 has a pair of spaced-apart end portions 42, each of which is adapted to be mounted in the aforementioned means 20 for retaining the end portions of a torsion beam in nonrotatable relationship with respect to the housing 10. In the preferred embodiment, illustrated and described herein, the spaced-apart end portions 42 of the torsion beam 36 have a cross-sectional shape that on three sides, as best seen in FIG. 5, is defined by a plurality of flat surfaces 44 arranged in proximate orthogonal relationship with respect to each other.

The means 20 for retaining the end portions of a torsion beam in nonrotatable relationship with respect to the housing 10 includes a pair of notches 46 that are formed on the interior surface 14 of the housing 10. In the illustrated embodiment, best shown in FIG. 2, each of the notches 46 is formed by a slot below an embossment 48 disposed on each side of the opening 18 in the housing 10. More specifically, each of the embossments 48 have a lower flat surface 49 that extends outwardly in a generally perpendicular direction from a portion of the interior surface 14 of the housing 10. Each of the embossments 48 also have an upper surface 51 disposed in a downwardly angular direction from a contiguous portion of the interior surface 14 of the housing 10 toward a lower flat surface 49 of the embossment 48.

Figure 5:
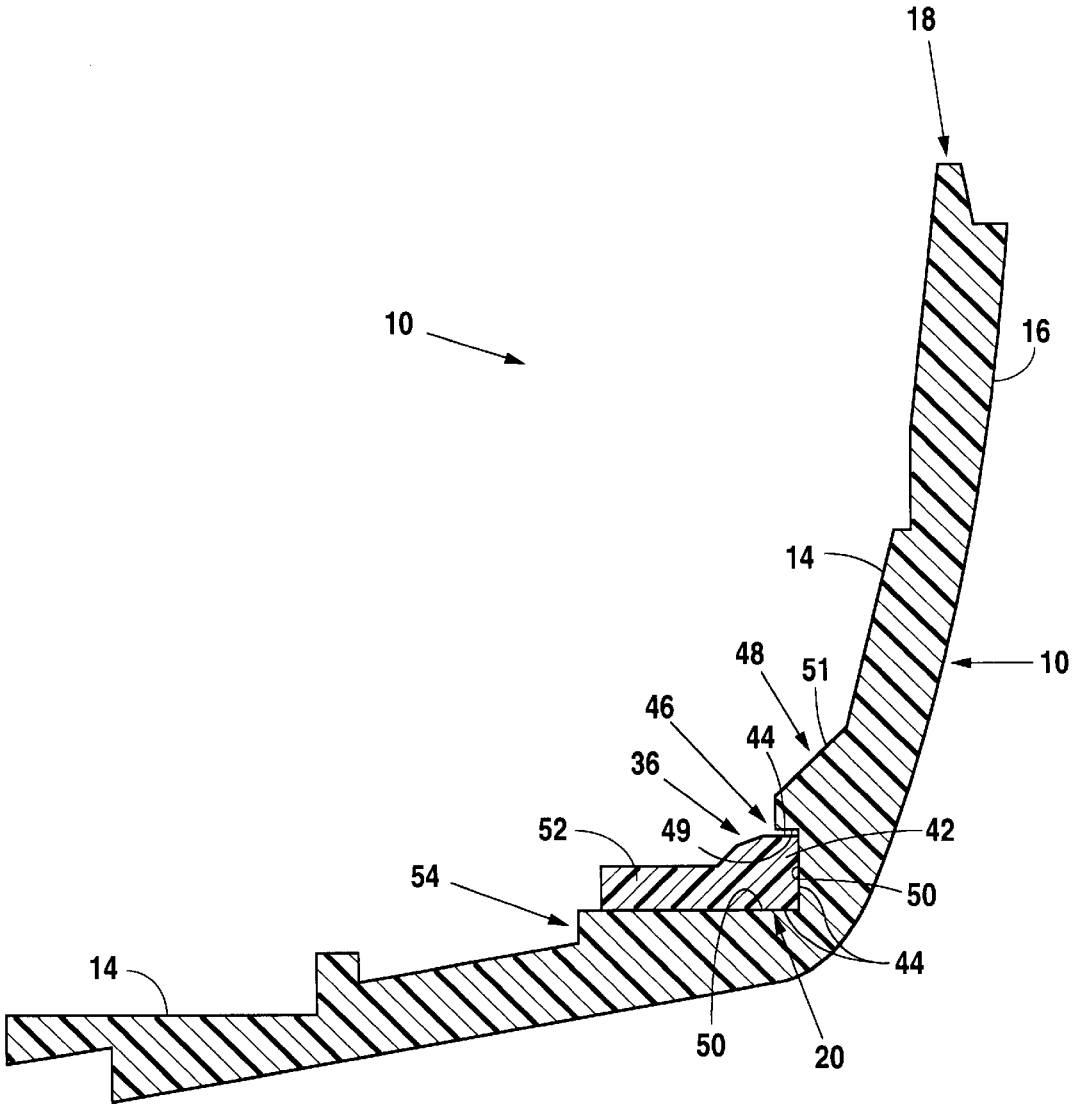
FIG. 5 is a cross-section view taken along the lines 5—5 of FIG. 1.

The notches 46 are generally defined by the lower flat surfaces 49 of the embossments 48 and additional adjacently disposed flat surfaces 50 that are arranged, as best shown in FIG. 5, in cooperation with the lower flat surfaces 49 of the embossments 48, to mate with the flat surfaces 44 defined on respective end portions 42 of the torsion bar 36.

Resistance to rotation of the torsion beam 36 with respect to the housing 10 is further provided by a pair of arms 52, each member of the pair being respectively disposed at a position with each of the end portions 42 of the torsion beam 36, and which extend radially outwardly from each of the spaced-apart end portions 42. The arms 52 respectively extend radially outwardly from the torsion beam 36 at an angle whereat the arms are in contact with a surface of the housing 10 whereby rotation of the end portions 42 in a counter-clockwise direction, as viewed from the right end of the torsion beam as viewed in FIG. 1, is prevented.

In the preferred embodiment, a pair of anti-rotation platforms 54, formed on the bottom internal surface 14 of the housing 10, may be provided as reaction surfaces for the arms 52. Alternatively, the arms 52 can be shaped so that they directly abut the bottom surface 14 of the housing 10. When installed, as described below in greater detail, the anti-rotation platforms 54 abut a lower surface of a respective one of the arms 52 when the tactile surface 24 of the actuator button 12 is not depressed. Depression, or a pushing motion, on the tactile surface 24 of the actuator button 12 forces the base 28 to move inwardly from the external surface 16 of the housing 10. Resistance to the inward motion of the actuator button 12 is provided by the cantilevered beam 38, which partially deflects in a flexural bending mode, and by twisting the intermediate portion 40 of the torsion beam in the aforementioned counter-clockwise direction with respect to the end portions 42 of the torsion beam 36. Thus, both a bending force provided by the cantilevered beam 38 and a torsional force provided by the torsion beam 36, provides a bias force between the arms 52 and the anti-rotation platforms 54 that is sufficient to return the actuator button to its initial position upon release. At the initial, or normal position, the first surface 30 of the base 28 is in direct biased abutment with the internal surface 14 of the housing 10.

Advantageously, the first and second portions 22, 26 of the actuator button 12 are integrally formed as a single, one-piece member. More specifically, the base 28, the torsion beam 36, and the cantilevered beam 38 components of the actuator button 12 are formed by injection molding of a suitable plastic material. As described above, the tactile surface 24 of the first portion 22 may be formed of a different material such as silicon rubber, and attached to the base 28 as an insert either during or after molding the button 12.

Figure 3:
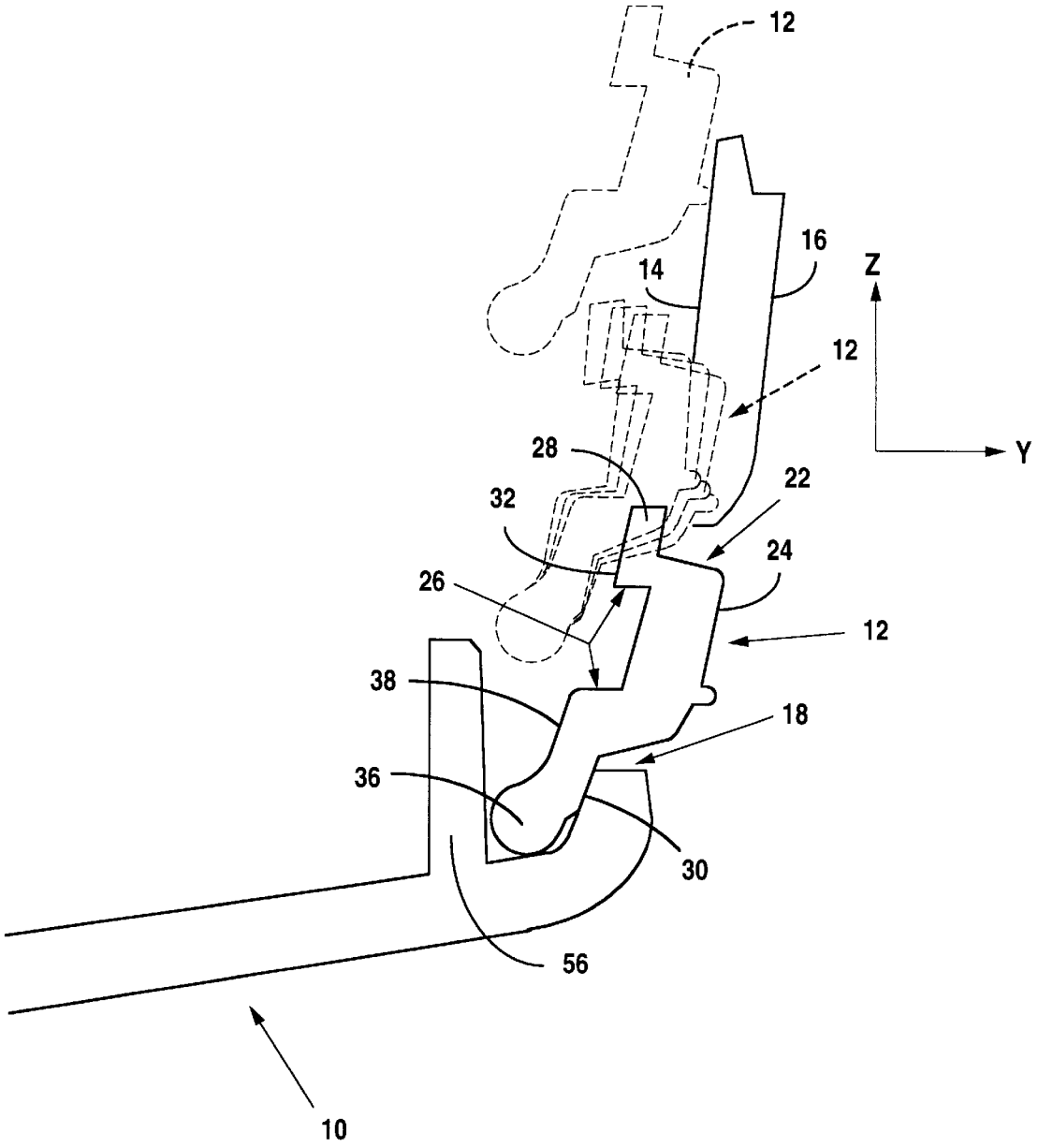
FIG. 3 is a schematic view of the straight-line, vertical assembly motion, by which the actuator button is assembled with the housing.

An important feature of the housing and actuator button assembly embodying the present invention is the ease with which the two components can be assembled. As represented in FIG. 2 by dashed lines, the actuator button 12 can be assembled by lowering the button 12 in a negative direction, i.e., vertically downwardly, along the Z axis in a Cartesian coordinate system of three dimensions in which the X and Y axis are disposed in a horizontal plane perpendicular to the Z axis, as identified in FIG. 2. When lowered vertically, the actuator button 12 bears against the internal surface 14 of the housing 10. Continued movement of the actuator button 12 is in the −Z direction seats the arms 52 and the flat surfaces 44 of the torsion beam 36, whereat the end portions 42 of the torsion beam 36, spaced-apart from each other along the defined X axis, snap into place in the notches 46. More specifically, as illustrated in FIG. 3, the actuator button 12 is lowered in the negative Z direction with the tactile surface 24 of the first portion 22 of the actuator button 12 in biased contact with the interior surface 14 of a top, or forward, portion of the internal surface 14 of the housing 10. As the actuator button proceeds in the negative Z direction, the actuator button 12 is deflected in the negative Y direction, away from the internal surface 14, until the first portion 22 of the actuator button 12 is aligned with the opening 18 in the housing 10. This feature enables automated, robotic assembly of the actuator button 12 in the housing 10.

Figure 4:
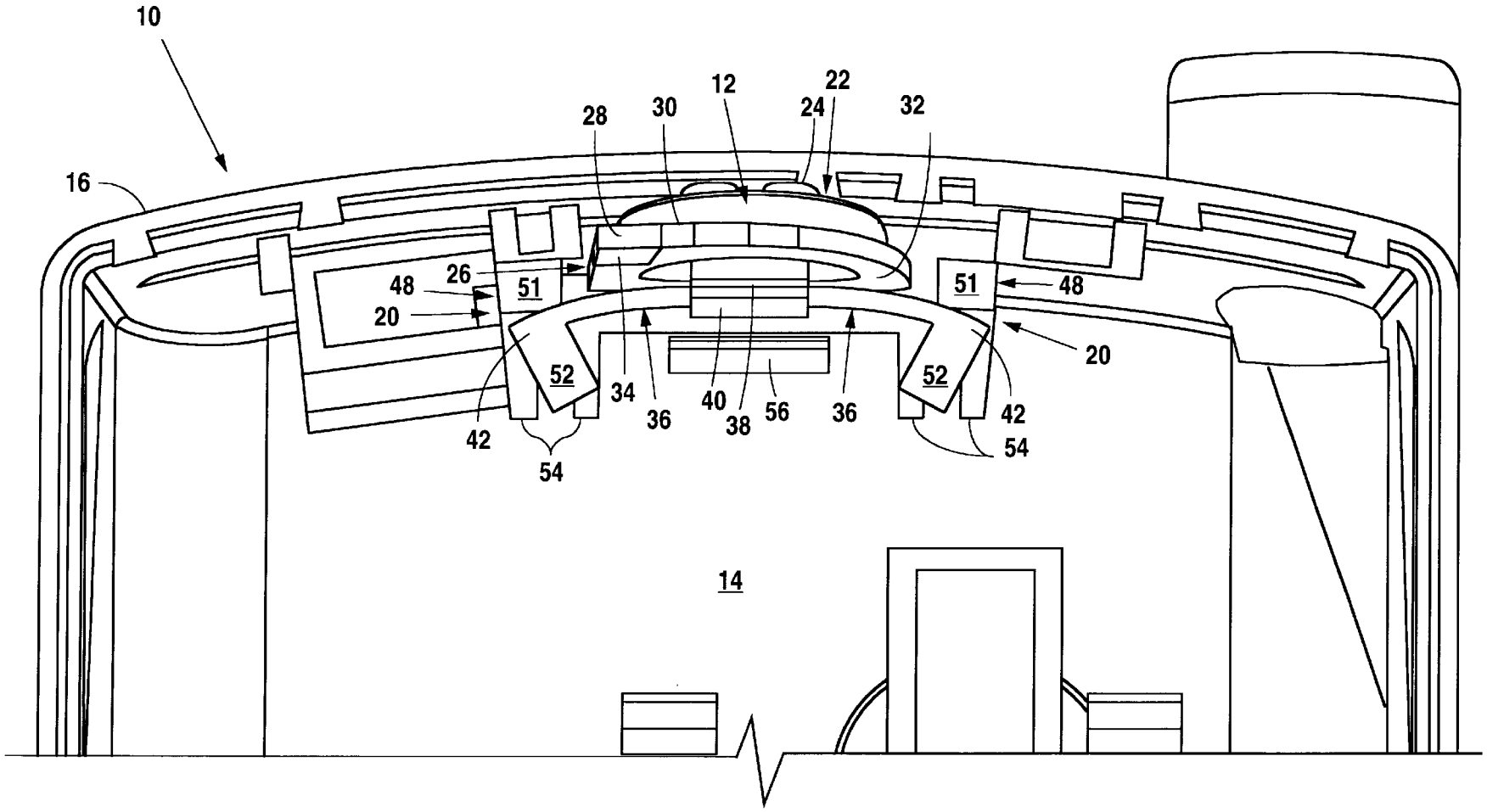
FIG. 4 is a plan view of the housing and actuator button assembly embodying the present invention, showing the torsion bars of the actuator button in a deflected position during assembly with the housing.

As best shown in FIG. 4, a rear stop 56 extends outwardly from the internal surface 14 of the housing 10 serves as a lead-in feature during assembly, and limits the movement of the torsion beam 36 in the −Y direction away from the internal surface 14 of the housing 10, both during assembly and after assembly when the tactile surface 24 of the actuator button 12 is pressed inwardly. When lowered downwardly, the end portions 42 of the torsion beam 36 are deflected in the −Y direction, away from the internal surface 14 of the housing 10, by the tapered surfaces of the embossments 48. When the first portion 22 of the actuator button 12 is properly centered in the opening 18 of the housing 10, the end portions 42 of the torsion beam 36 snap into the notches 46, which are best shown in FIGS. 2 and 5, whereupon the torsion beam 36 is retained in fixed relationship with the housing 10.

In the illustrated embodiment of the present invention, the housing 10 has a printed circuit board 58, shown in FIG. 6, on which the electrical switch 60 is mounted in proximal but normally spaced relationship from the pad 34 of the actuator button 12. The pressure-actuated electrical switch 60 of the printed circuit board 58 and the pad 34 of the actuator button 12 are brought into mutual physical contact in response to depressing the tactile surface 24 of the first portion 22 of the actuator button 12.

The combination of a cantilevered beam 38 interconnecting the base 28 of the actuator button 12 with a torsion beam 36 allows the button 12 to operate in very small, limited spaces. With the cantilever-torsional combination, the travel of the button is greater because the stress of the deflection is distributed between torsional stress and bending stress. Because electronic devices in general, and telecommunication instruments such as cellular phones in particular, are becoming smaller and smaller, the room available for a cantilever design is greatly restricted. Space savings in the interior enclosure space are extremely important or even, in some applications, critical to instrument design. In a cantilever design, the force and stress is a function of beam length. To achieve the required deflection, with the desired force, within the stress limitations of the specified material, a certain length of beam length is required. Often, especially when the given geometry of the instrument dictates, there is not enough room for a cantilever design. The combined use of a torsional element 36, in combination with a cantilever beam 38, allows the button 12 to be designed in a smaller space, e.g., short cantilever beam length, while achieving the requirement for deflection, force, and stress.

The one-piece design of the actuator button 12 and the absence of any requirements for secondary operations during assembly result in a less complicated, less expensive actuator button arrangement. The Z-axis snap assembly of the actuator button 12 into the housing 10 permits automated robotic assembly, as well as easier assembly when robots are not used, due to the lack of any need to rotate or laterally translate the respective parts during assembly.

Turning again to FIG. 6, it can be readily seen that movement of the pad 34 on the base 28 toward the pressure-actuated electrical switch 60 on the printed circuit board 58 is accomplished by inducing bending stress in the cantilevered beam 38, and torsional stress in the torsion beam 36. A torsional force is developed in the torsion beam 36 because the beam 36 is free to rotate along the entire length of the intermediate portion 40, with the end portions 42 being constrained by the notches 46 and the anti-rotation platforms 54.

The housing and actuator button assembly embodying the present invention provides a positive engagement of the pad 34 with the switch 34, return of the actuator button 12 to its original position through bias forces resulting from both bending stress and torsional stress, and provision of a tactile feedback indicating actuation of the electrical switch 60. Moreover, the actuator button 12 advantageously is of a one-piece construction that can be lowered vertically into engagement with the housing 10, and does not require additional attachment devices to retain the actuator button in its desired position with respect to the housing 10.

Although the present invention is described in terms of a preferred exemplary embodiment, with specific illustrative key constructions and shapes, those skilled in the art will recognize that changes in those constructions and shapes of the cantilevered beam 38, the torsion beam 36, the notches 46, and the anti-rotation platforms 54, may be made without departing from the spirit of the invention. Such changes are intended to fall within the scope of the following claims. Other aspects, features, and advantages of the present invention may be obtained from a study of this disclosure and the drawings, along with appended claims.

What is claimed is:

1. A housing assembly, comprising:

a housing having an internal surface and an external surface, at least one opening extending between said internal surface and said external surface, and a pair of notches disposed on the internal surface of the housing and adapted to retain respective spaced-apart end portions of a torsion beam; and an actuator button having a first portion extending through said opening in the housing, and a second portion disposed within said housing, said second portion having a base from which said first portion of the actuator button extends, an elongated torsion beam spaced from said base and having a pair of spaced-apart end portions each adapted to be mounted in a respective one of said pair of notches on the internal surface of the housing and further including an intermediate portion disposed between said spaced-apart end portions, and a cantilevered beam extending between said intermediate portion of the torsion beam and said base of the actuator button and attached in respective fixed relationship to said intermediate portion of the torsion beam and to said base of the actuator button.

2. A housing assembly, as set forth in claim 1, wherein the first and second portions of the actuator button are integrally formed as a single, one-piece member.

3. A housing assembly, comprising:

a housing having an internal surface and an external surface, at least one opening extending between said internal surface and said external surface, and a pair of notches disposed on the internal surface of the housing and adapted to retain respective spaced-apart end portions of a torsion beam, each of the spaced-apart end portions of the torsion beam having a cross-sectional shape at least partially defined by a plurality of generally orthogonal flat surfaces arranged in a predefined relationship with each other, and each one of the pair of notches formed on the interior surface of said housing having a plurality of flat surfaces that are arranged to mate with the flat surfaces defined on a respective end of the torsion beam; and an actuator button having a first portion extending through said opening in the housing, and a second portion disposed within said housing, said second portion having a base from which said first portion of the actuator button extends, an elongated torsion beam spaced from said base and having a pair of spaced-apart end portions each adapted to be mounted in a respective one of said pair of notches on the internal surface of the housing and further including an intermediate portion disposed between said spaced-apart end portions, and a cantilevered beam extending between said intermediate portion of the torsion beam and said base of the actuator button and attached in respective fixed relationship to said intermediate portion of the torsion beam and to said base of the actuator button.

4. A housing assembly, as set forth in claim 3, wherein said housing includes a pair of anti-rotation platforms disposed on the internal surface of the housing in spaced relationship from each other at a distance substantially equal to the spaced-apart distance of the end portions of the torsion beam, and said torsion beam has an arm extending radially outwardly from each of the spaced-apart end portions at a radial position whereat each of said arms abuts a respective one of the anti-rotation platforms.

5. A housing assembly, as set forth in claim 3, wherein said housing includes a pair of anti-rotation platforms disposed of the internal surface of the housing in spaced relationship from each other at a distance substantially equal to the spaced-apart distance of the end portions of the torsion beam, and said torsion beam has an arm extending radially outwardly from each of the spaced-apart end portions at a radial position, whereat each of said arms is urged into biased abutment with a respective one of the anti-rotation platforms in response to depressing the tactile surface of the actuator button.

6. A housing assembly, as set forth in claim 1, wherein said base of the second portion of the actuator button has a first surface and a second surface respectively disposed on opposed sides of the base, said first portion of the actuator button being disposed on said first surface of the base, and said second surface of the base having an electrical switch contact pad disposed thereon.

7. A housing assembly, as set forth in claim 6, wherein said housing includes a printed circuit board having a pressure-actuatable electrical switch disposed thereon in proximal, normally spaced, relationship with the electrical switch contact pad disposed on the base of the actuator button, said pad on the base being brought into pressure contact with the electrical switch on the printed circuit board in response to depressing the tactile surface of the first portion of the actuator button.

8. A housing assembly, as set forth in claim 7, wherein said housing comprises a component of a case of a telecommunication instrument and said electrical switch on the printed circuit board controls the operation of at least one circuit of the telecommunication instrument in response to manually depressing the actuator button.

9. A housing assembly, comprising:

a housing having an internal surface and an external surface, at least one opening extending between said internal surface and said external surface, and a pair of notches disposed on the internal surface of the housing and adapted to retain respective spaced-apart end portions of a torsion beam, said pair of notches being defined by a pair of embossments each of which have a lower surface extending outwardly from a portion of the interior surface of the housing, a pair of anti-rotation platforms each of which is vertically aligned and spaced from the lower surface of a respective one of said embossments, and a portion of said interior surface of the housing extending between the lower surface of each of the embossments and the respective vertically aligned anti-rotation platform; and an actuator button having a first portion extending through said opening in the housing, and a second portion disposed within said housing, said second portion having a base from which said first portion of the actuator button extends, an elongated torsion beam spaced from said base and having a pair of spaced-apart end portions each adapted to be mounted in a respective one of said pair of notches on the internal surface of the housing and further including an intermediate portion disposed between said spaced-apart end portions, and a cantilevered beam extending between said intermediate portion of the torsion beam and said base of the actuator button and attached in respective fixed relationship to said intermediate portion of the torsion beam and to said base of the actuator button.

10. A housing assembly, as set forth in claim 9, wherein each of said embossments have an upper surface disposed in an angular direction away from a contiguous portion of the interior surface of the housing and toward the lower surface of the embossment, and said actuator button being assembled with said housing in response to moving the actuator button downwardly from a position spaced vertically above said pair of notches to a position at which each of said pair of end portions of the torsion beam is brought into contact with the angled upper surface of a respective one of said embossments, continuing said downward movement whereby each of said pair of end portions of the torsion beam are bent in a direction away from said embossments, and further continuing said downward movement to a position at which said pair of end portions of the torsion beam are vertically aligned with said notch, whereupon each of the end portions of the torsion beam snap into a respective one of said notches and said first portion of the actuator button is positioned within said opening in the housing.

11. An actuator button, comprising:

a first portion adapted to extend through an opening in a housing and having a tactile outer surface; and a second portion having a base from which said first portion of the actuator button extends, an elongated torsion beam spaced from said base and having a pair of spaced-apart end portions each adapted for mounting in fixed relationship with said housing and an intermediate portion disposed between said spaced-apart end portions, and a cantilevered beam extending between said intermediate portion of the torsion beam and said base of the actuator button and attached in respective fixed relationship to said intermediate portion of the torsion beam and to said base of the actuator button.

12. An actuator button, as set forth in claim 11, wherein the first and second portions of the actuator button are integrally formed as a single, one-piece member.

13. An actuator button, as set forth in claim 11, wherein each of the spaced-apart end portions of the torsion beam have a cross-sectional shape at least partially defined by a plurality of generally orthogonal flat surfaces arranged in a predefined relationship with each other.

14. An actuator button, comprising:

a first portion adapted to extend through an opening in a housing and having a tactile outer surface; and a second portion having a base from which said first portion of the actuator button extends, an elongated torsion beam spaced from said base and having a pair of spaced-apart end portions each adapted for mounting in fixed relationship with said housing and an intermediate portion disposed between said spaced-apart end portions, and a cantilevered beam extending between said intermediate portion of the torsion beam and said base of the actuator button and attached in respective fixed relationship to said intermediate portion of the torsion beam and to said base of the actuator button, said torsion beam having an arm extending radially outwardly from each of the spaced-apart end portions at a radial position whereat each of said arms is adapted for abutment with a predefined portion of the housing.

15. An actuator button, as set forth in claim 14, wherein each of said arms is adapted to be urged into biased abutment with a respective predefined portion of the housing in response to depressing the tactile surface of the actuator button.

16. An actuator button, as set forth in claim 11, wherein said base of the second portion of the actuator button has a first surface and a second surface respectively disposed on opposed sides of the base, said first portion of the actuator button extending outwardly from said first surface of the base, and said second surface of the base having an electrical switch contact pad disposed thereon.

17. An actuator button, as set forth in claim 11, wherein said actuator button operatively controls at least one circuit of a telecommunication instrument in response to manually depressing the tactile surface of the first portion of the button.

* * * * *